United States Patent [19]

Tsubonuma et al.

[11] Patent Number: 4,537,536

[45] Date of Patent: Aug. 27, 1985

[54] PROCESS AND APPARATUS OF CONSTRUCTING A WATER TIGHT UNDERGROUND PILE WALL

[75] Inventors: Yoshio Tsubonuma, Hoya; Tohru Kawai, Chiba, both of Japan

[73] Assignee: The Shimizu Construction Co., Ltd., Tokyo, Japan

[21] Appl. No.: 543,071

[22] Filed: Oct. 18, 1983

[51] Int. Cl.[3] ..... E02D 5/18

[52] U.S. Cl. ..... 405/267; 405/240; 405/241

[58] Field of Search ..... 405/267, 233, 237, 238, 405/240, 241, 242

[56] References Cited

U.S. PATENT DOCUMENTS

| | | | |
|---|---|---|---|
| 2,791,886 | 5/1957 | Veder | 405/267 |
| 3,139,729 | 7/1964 | Miotti | 405/267 |
| 3,839,871 | 10/1974 | Dyer et al. | 405/267 |
| 4,065,928 | 1/1978 | Takagi et al. | 405/267 |
| 4,199,279 | 4/1980 | Himeji et al. | 405/303 |
| 4,212,565 | 7/1980 | Watabe | 405/269 |

FOREIGN PATENT DOCUMENTS

| | | | |
|---|---|---|---|
| 0028937 | 3/1981 | Japan | 405/267 |
| 0101930 | 6/1983 | Japan | 405/267 |

*Primary Examiner*—Dennis L. Taylor

*Attorney, Agent, or Firm*—Weingarten, Schurgin Gagnebin & Hayes

[57] ABSTRACT

This invention relates to a process and an apparatus of constructing a water tight underground pile wall in the form of a row of piles in which previous piles are installed every other pile and thereafter subsequent piles are installed between said previously formed piles, both of said piles being connected together.

7 Claims, 10 Drawing Figures

PROCESS AND APPARATUS OF CONSTRUCTING A WATER TIGHT UNDERGROUND PILE WALL

BACKGROUND OF THE INVENTION

This invention relates to a process and apparatus of constructing a water tight underground pile wall in the form of a row of piles in which previous piles are installed every other pile and thereafter subsequent piles are installed between said previously formed piles, both of said piles being connected together.

As for the process of this kind, it has been often employed a process wherein as shown in FIG. 1, in the installation of subsequent piles 2 between previous piles 1 installed at intervals of every other pile, cement paste is jetted under high pressure towards the side of the previously formed pile 1 from the side of the subsequently formed pile and the earth is cut and then the cement paste flows thereinto to form a cut-off film 3 in a portion d between the piles.

In accordance with the prior art process, there sometimes occurs a case where if the vertical accuracy of the previously formed piles 1 and the subsequently formed piles 2 and the execution accuracy of the center of piles are poor, the distance d between the piles exceeds the set value or they extend in skew line to each other, and cement paste by jetting does not reach the side of the previously formed pile 1, thus failing to obtain a complete cut-off film 3.

Also, there sometimes occurs a case, depending on the conditions of the earth, where the earth between the piles may not be cut by the jet cement paste and a case where as shown in FIG. 2, the cement paste is spread along the earth layer around the side of the previously formed pile 1, failing to form the cut-off film 3 connecting the piles.

Moreover, even if the earth is cut by the jet cement paste, there remains many problems in terms of the cut-off properties such that the cut-off film 3 is thin and disconnected as shown in FIG. 3, which is not yet satisfactory.

SUMMARY OF THE INVENTION

The present invention eliminates the disadvantages noted above with respect to conventional processes and has been developed in order to always obtain the positive cut-off effects without being greatly affected by the execution accuracy of the piles and by the conditions of the earth.

To achieve the above-described object, in accordance with the present invention, the cut-off properties by the row of piles do not depend on the cut-off film formed between the piles but the row of piles is unified by the direct connection of piles to each other and by the engagement of connected portions to enhance the cut-off properties.

The aforesaid direct connection of the piles to each other is accomplished by subsequently installing, between piles having a low strength previously installed pair by pair at intervals of every other pile, the other subsequent piles while lappihg over the previously formed piles. The engagement between the connected portions is accomplished, in the installation of the subsequent piles, by mechanically and vertically cutting the opposed sides of the previously formed piles and filling a part of the subsequently formed piles in grooves formed therein.

In the pile wall in the form of a row of piles constructed as described hereinbefore, the watertight properties are greatly increased by the connection of piles to each other by way of lapping and by the engagement within the piles. Further, since the grooves for the engagement are mechanically cut, any of the previously formed piles provide the cut grooves of the same form and high accuracy and the piles are tightly and uniformly unified to exhibit the cut-off effect that may not be obtained by the aforementioned conventional process.

The execution of the aforesaid previously formed piles and subsequently formed piles and the connection of piles to each other may be easily and positively accomplished by the use of a construction device which comprises two augers.

In the construction device, a pair of augers having spiral flights connected around a hollow shaft and spreadably provided with cutting blades on both sides of a head is provided on a driving device in a requested spaced relation. In the execution of the subsequently formed piles, said blades are spread, and the augers are raised so that the sides of adjacent piles are vertically cut by the blades to form grooves.

BRIEF DESCRIPTION OF THE DRAWINGS

An embodiment of the invention is described below with reference to the accompanying drawings wherein:

FIG. 4 being a schematic front view of the construction device,

FIGS. 5 to 7 being respectively cross sectional plan views for explanation of the construction process, FIG. 8 being a longitudinal sectional front view of a part of a pile wall, FIG. 9 being a front view of the foremost end of the auger, and FIG. 10 being a longitudinal sectional view of the same.

DETAILED DESCRIPTION OF A PREFERRED EMBODIMENT

Figure 1:
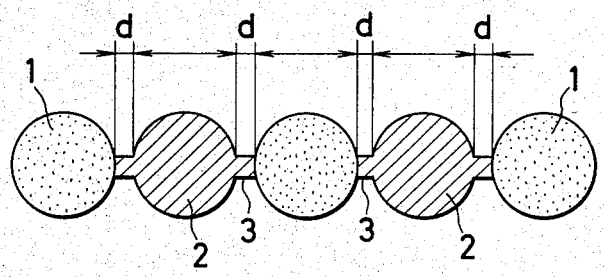
FIG. 1 is a cross sectional plan view for explanation of a conventional process for constructing a pile wall in the form of a row of piles.
Figure 2:
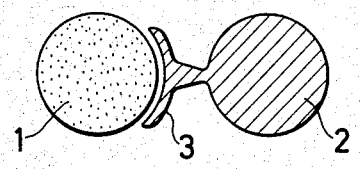
FIGS. 2 and 3 are respectively cross sectional plan views showing drawbacks encountered in the conventional process.
Figure 3:
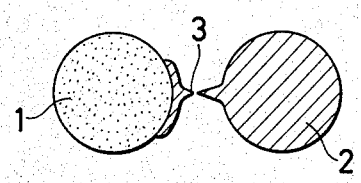
Figure 4:
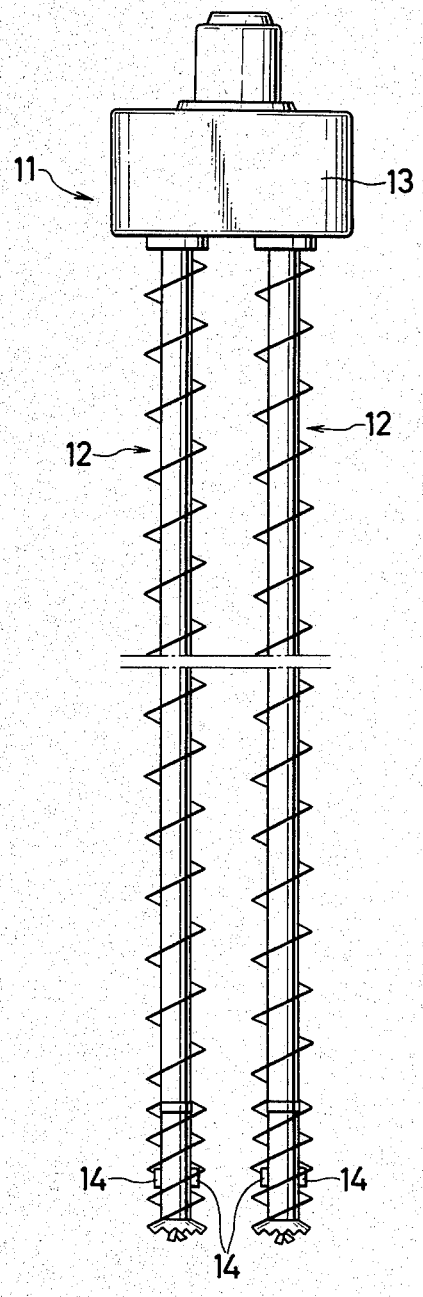
FIGS. 4 to 10 show an embodiment of a process and apparatus for constructing a pile wall in the form of a row of piles in accordance with the present invention.
Figure 5:
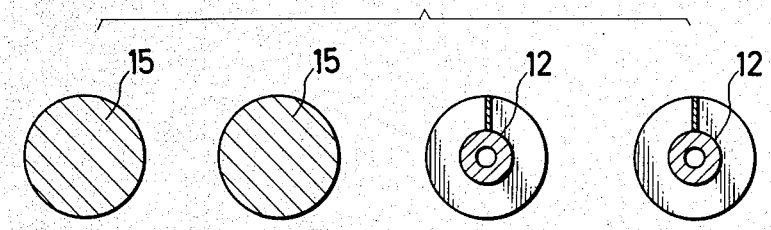
Figure 6:
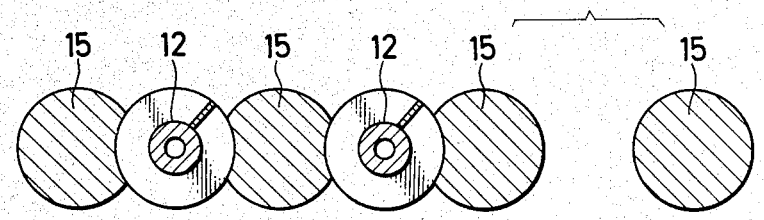
Figure 7:
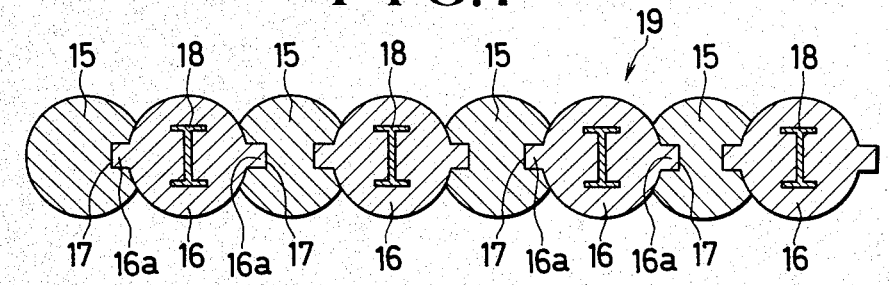
Figure 8:
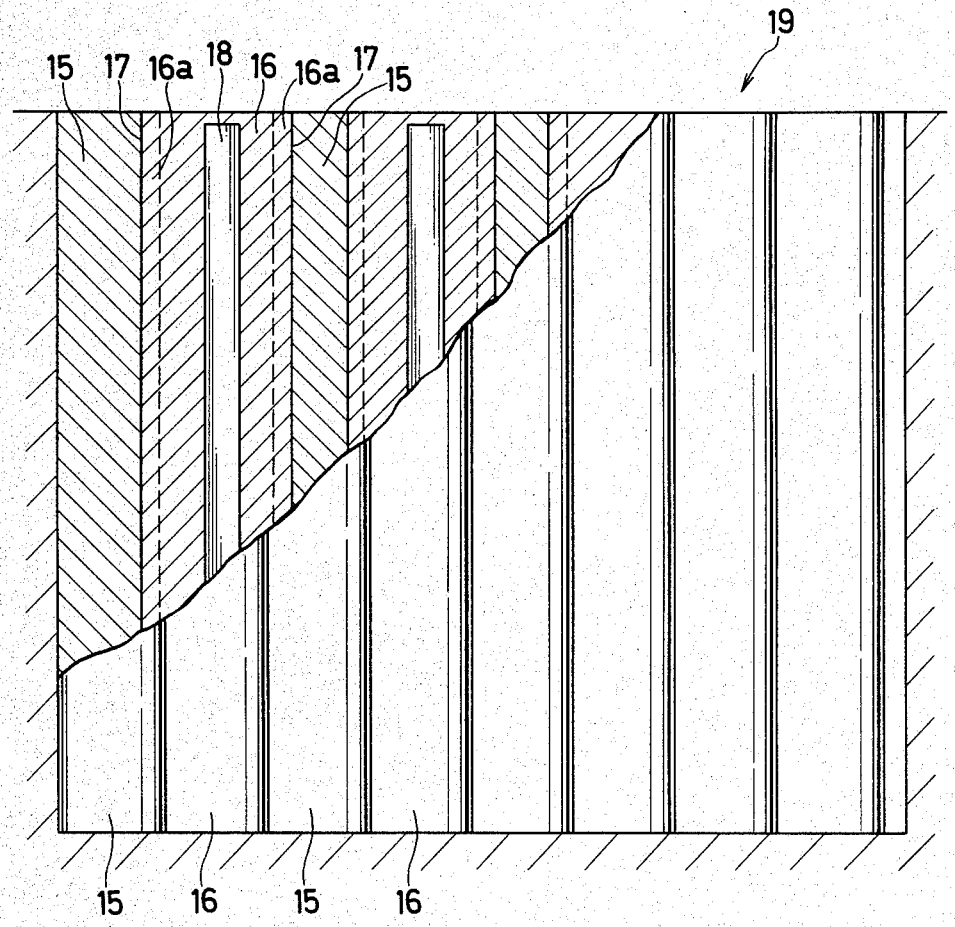

An embodiment of the present invention will now be described in detail with reference to FIGS. 4 to 10.

A reference numeral 11 denotes a construction device which comprises two augers in which a pair of augers 12, 12 having spiral flights disposed about shafts thereof is provided parallel to each other on a driving device 13. Blades 14, 14 are spreadably provided on both sides of the heads of said augers 12, 12, respectively. These augers 12, 12 are provided on said driving device 13 in a spaced relation to each other so that by said augers, a pair of previous piles may be installed and the subsequent piles lapped over said previous piles may be installed.

First, pile holes are excavated by said construction device 11, mortar of poor mix is poured into the pile holes (from the auger head) while raising the device, and piles 15 of low strength are previously installed pair by pair at intervals of every other pile.

Next, the earth between the previously formed piles 15, 15 is excavated by the same construction device 11. In this case, the spiral flights diameter of the augers 12, 12 lap in the horizontal section over the previously formed piles 15, 15 to circularly excavate the sides of the previously formed piles 15, 15 together with the earth.

After the excavation has been finished, both the augers are stopped to adjust the direction of the augers 12, 12 so that the blades 14, 14 are positioned towards the center of the sides of the adjacent piles. The blades 14, 14 are spread by the device disposed within the shaft and the foremost ends of the blades are forced into the adjacent piles.

Figure 9:
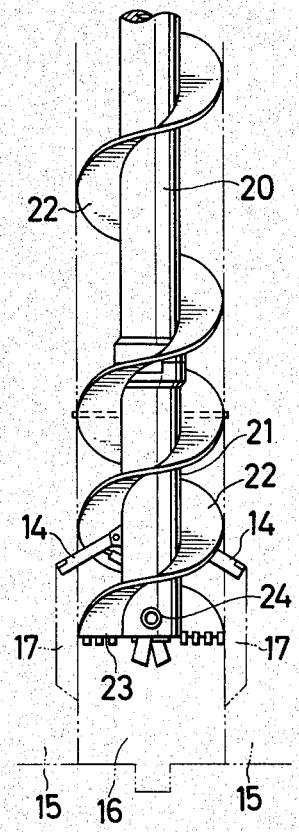

After the aforesaid preparation has been completed, the low-pressured mortar fed into the shaft under pressure is poured into gaps formed by raising the auger heads from an opening port 24 while gradually raising the construction device 11, and piles 16 are installed. At this time, the aforesaid blades 14, 14 further cut the central portion of the sides of the previously formed piles 15, 15 cut into a circular configuration as shown in FIG. 9 to form vertical grooves 17, 17 therein. The depth of the cut grooves 17, 17 vary with the spreading angle of the blades 14, 14 and can be suitably changed.

Mortar forced out of the auger heads for forming the piles is partly poured into the mechanically cut grooves in a manner as described above as the augers 12, 12 move upward, and the subsequently formed piles 16, 16 and the previously formed piles 15, 15 lap over one another and are connected watertightly and united by the engagement between the cut grooves 17, 17 and parts **16*a*, 16*a*** of the subsequently formed piles installed therein.

After the subsequently formed piles 16, 16 have been installed, the construction device 11 is transferred to the other location, and immediately, inserts 18 such as H-steel are forced into the subsequently formed piles. The aforementioned steps are repeatedly carried out to complete a pile wall in the form of a row of piles 19 having the inserts 18 every other insert.

Figure 10:
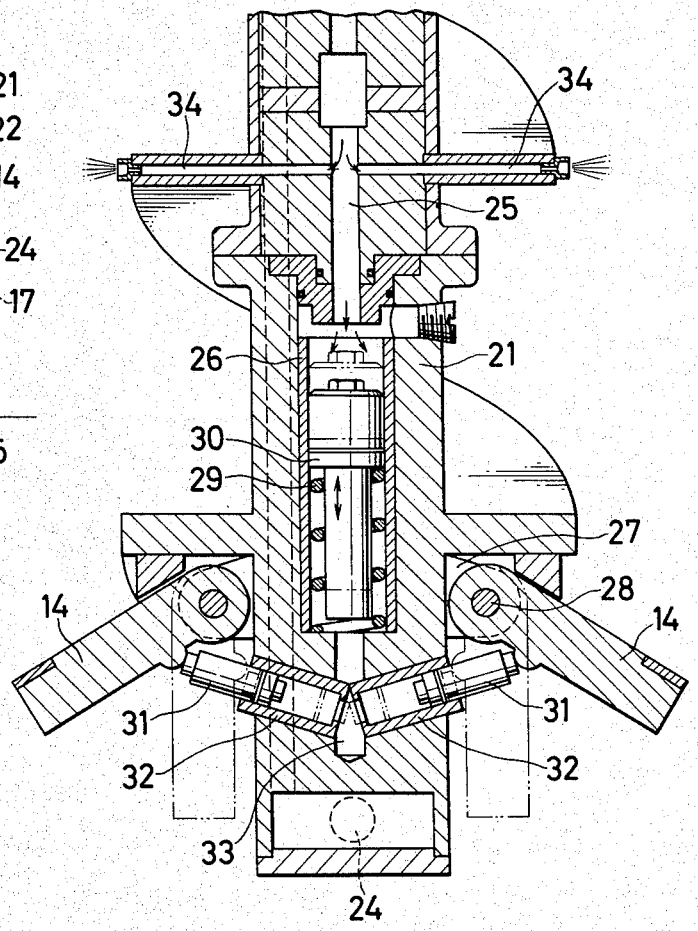

FIGS. 9 and 10 show the foremost end of the aforesaid auger 12. A reference numeral 20 denotes a shaft, and 21 denotes a head member joined to the lower end of the shaft. The shaft 20 and the head member 21 have spiral flights 22. disposed on the circumference thereof, and excavation bits 23 are mounted on the foremost end of the head member 22.

The shaft 20 and the head member 21 are internally provided with the low-pressured mortar feeding passage having an opening port 24 located in the side of the foremost end of the head member 21, though not shown. The shaft is also internally provided with a high pressure fluid flow passage 25, and a cylinder 26 connected to the flow passage 25 is provided internally of the head member 21.

This cylinder 26 is provided to be normally operated by water, pressure and to spread the pair of blades 14, 14 which are hung through pivots 28 on bearings 27 projected on both sides of the lower portions of the head member 21 and has a piston 30 normally biased upwards by means of a spring member 29. Below the cylinder 26 is opposedly provided a pair of plungers 31, 31 for upwardly spreading said blades 14, said plungers being inserted into casings 32, 32 in contact with the lower surfaces of said blades 14. A communication hole 33 is provided between the plungers 31, 31 and the cylinder 26.

A pair of nozzle members 34, 34 in communication with the high pressure flowpassage 25 in the shaft is horizontally incorporated into the spiral flights 22 around the shaft so that fluids fed under pressure to the flowpassage 25 and made to be the high pressured mortar press the piston 30 and are jetted out of the end edges of the spiral flights through the nozzle members 34, 34.

The high pressure jetting through said nozzle members 34, 34 is used when the previously formed piles 15, 15 are sufficiently cured and are cut. That is, the sides of the previously formed piles 15, 15 cut by the flights are primarily cut by jetting under high pressure a coagulating agent such as cement paste through the nozzles in contact with said sides, and thereafter further cut by the blades 14, 14 to form said cut grooves 17, 17 having a predetermined dimension.

As described above, in the present invention, the subsequently formed piles are installed between the previously formed piles in a lapped fashion one another, the vertical cut grooves are formed opposedly of the previously formed piles at the lapped portions, and the cut grooves and a part of the subsequently formed piles are connected in the engaging condition and unified, and therefore, the positive cut-off properties may be obtained even if the execution accuracy of piles is somewhat deteriorated. Moreover, since, the grooves are mechanically cut, the grooves are not affected by the conditions of the earth to provide formation of the cut grooves having dimensions as set and pouring of materials into the cut grooves for each pile, thus completely preventing a water leakage from the pile wall when excavation is completed in one side of a row of piles.

Moreover, with respect to the construction device itself, it will suffice that two augers comprising a pair of augers, in which blades are spreadably disposed on both sides of the auger head, are provided in a spaced relation. Furthermore, since both the flights are separated, crossing of the flights each other and difficulty in discharge of excavated soil will not possibly occur even if the number of revolutions of both the augers and the spacing between the flights are not brought into complete coincidence, as in the case where the flights lap over each other. Moreover, there are advantages in that the geared motors as the driving source can be formed into two systems and are not necessary to have them synchronized each other and the operation is easily accomplished in the execution of the pile wall in the form of a row of piles.

What is claimed is:

1. Apparatus for producing an elongated water-tight pile wall consisting of a row of mutually overlapping and mutually interpenetrating subsequently and previously formed adjacent pile wall portions such that one previously formed pile wall portion has a longitudinally extending groove therein and an adjacent subsequently formed pile wall portion has a longitudinally extending torque that is received in the groove to provide a water-tight interlock therebetween, comprising:

a drive;

a pair of longitudinally extending and generally parallel augers operative to excavate the earth for corresponding previously formed and subsequently formed pile wall portions each mounted on an end thereof for rotary motion to said drive and axially spaced by a distance less than the opertive width dimension of an auger to insure overlapping between adjacent previously formed and subsequently formed pile wall portions, each auger having a hollow shaft;

a hollow cutting head having a tip mounted for rotation with the elongated shaft of each auger with the hollow of the head in fluid communication with the hollow of the shaft and in fluid communication with an aperture provided therefor in said tip;

first and second pairs of elongated cutting blades each having ends having an operative generally rectangular geometry of dimensions selected to be less than the operative width of an auger to cut said grooves in adjacent previously formed pile wall portions;

first means for mounting said first pair of cutting blades to one of said heads for motion between a first position where the lateral dimension defined between the ends of said first pair of cutting blades is less than the operative width dimension of its auger and a second position where the lateral dimension defined between the ends of said first pair of cutting blades is greater than the operative width dimension of its auger to allow the generally rectangular cutting blades to cut into the confronting surrface of the previously formed pile portions to form said longitudinally extending grooves to insure the mutual interpenetration of subsequently formed and previously formed adjacent pile wall portions;

second means for mounting said second pair of cutting blades to the other one of said heads for motion between a first position where the lateral dimension defined between the ends of said second pair of cutting blades is less than the operative width dimension of its auger and a second position where the lateral dimension defined between the ends of said second pair of cutting blades is greater than the lateral width dimension of its auger to allow the generally rectangular cutting blades to cut into the confronting surface of the previously formed pile wall portion to form said longitudinally extending grooves likewise to insure the mutual interpenetration of adjacent subsequently formed and previously formed adjacent pile wall portions; and means coupled to said augers and to said first and second pairs of cutting blades for selectively moving said first and said second pairs of cutting blades to a selected one of their first and second positions.

2. The invention of claim 1, wherein said augers each include a spiral cutting surface provided on the external surface of the associated hollow shaft.

3. The invention of claim 1, further including a pair of diametrically opposed nozzles provided along each of said augers at a point therealong remote from the end where they are coupled to said drive, and means coupled to said diametrically opposed nozzles and cooperative with said hollow shaft of said augers for injecting a preselected fluid through said nozzles.

4. The invention of claim 1, wherein said mounting means includes means for pivotally mounting each of said first and of said second pairs of cutting blades to its associated auger at a corresponding pivot axis.

5. The invention of claim 4, wherein said pivotally mounting means includes cylinders having plungers operative to apply a torque to said cutting blades at a point therealong remote from their pivot axis.

6. The invention of claim 5, wherein said moving means includes means coupled to said cylinders for controllably moving said plungers into abutting relation with said blades.

7. The invention of claim 6, wherein said moving means further includes a fluid flow passageway.

* * * * *